United States Patent [19]

Rudkin et al.

[11] 4,179,382

[45] Dec. 18, 1979

[54] TEXTILE CONDITIONING COMPOSITIONS CONTAINING POLYMERIC CATIONIC MATERIALS

[75] Inventors: Arthur L. Rudkin, Hitchin; John H. Clint; Kenneth Young, both of Whitley Bay, all of England

[73] Assignee: The Procter & Gamble Company, Cincinnati, Ohio

[21] Appl. No.: 955,559

[22] Filed: Oct. 27, 1978

[51] Int. Cl.[2] ..... D06M 13/26

[52] U.S. Cl. ..... 252/8.8; 8/115.6; 252/8.6

[58] Field of Search ..... 252/8.8, 8.6; 8/115.6

[56] References Cited

U.S. PATENT DOCUMENTS

| | | | |
|---|---|---|---|
| 2,826,506 | 3/1958 | Trusler | 252/8.6 |
| 3,992,304 | 11/1976 | Minegishi et al. | 252/8.8 |
| 4,031,307 | 6/1977 | DeMartino et al. | 252/8.6 |
| 4,077,890 | 3/1978 | Barker | 252/8.8 |
| 4,116,854 | 9/1978 | Temple et al. | 252/8.6 |

*Primary Examiner*—William E. Schulz

[57] ABSTRACT

A textile conditioning composition intended for use in the final rinse after a washing operation comprises a cationic textile softening agent and a small amount of a polymeric cationic salt of specified type, and optionally a substantially water insoluble nonionic textile softening agent, the weight ratio of nonionic textile softener to cationic components being in the ratio not greater than 10:1. Preferably, the compositions are in the form of an aqueous dispersion and contain a water-insoluble cationic surfactant in combination with a cationic polysaccharide. Especially useful compositions are based on di-tallow quaternary ammonium or imidazolinium salts and cationic guar gums.

11 Claims, No Drawings

TEXTILE CONDITIONING COMPOSITIONS CONTAINING POLYMERIC CATIONIC MATERIALS

BACKGROUND OF THE INVENTION

The invention relates to textile conditioning compositions employing cationic textile softening agents and containing certain polymeric substances which increase the effectiveness of the cationic textile agents employed.

Textile conditioning, especially softening, compositions in the form of aqueous dispersions are well known, and are primarily intended to be added to the last rinse liquor in a conventional clothes-washing process. Most of such compositions currently on the market comprise a fairly low concentration, for instance about 3–10%, of a cationic textile softener or of a mixture of more than one, together with relatively minor amounts of emulsifiers, and with aesthetic additives such as colour and perfume. These compositions are used at quite low concentration in the treatment bath, for instance about 0.25% by weight.

The rinse liquors, even the last, after a conventional bath using an anionic surfactant-based detergent composition normally contain traces of residual anionic surfactant carried through from the wash liquor. Typically 5–20 parts per million of anionic surfactant is present in the final rinse liquor. This anionic surfactant reacts with the cationic softener component of a softening compositions, thereby reducing its performance. The use of relatively water soluble cationic surfactants to scavenge anionic has been described in U.S. Pat. No. 3,974,076, but these substances need to be used at considerable levels.

It has now been found that this scavenging function can be performed by very low levels of certain polymeric cationic salts. Furthermore some of these salts have been found to have softening properties in the presence of cationic softeners even when employed in baths which contain no anionic surfactant, and they even replace several times their own weight of conventional cationic softener without overall loss of softening performance of the composition. This enables the cost of such compositions to be reduced.

German Offeblengungsschrift No. 2,724,816 describes textile softening and ironing assistants containing cationic softeners or mixtures thereof with nonionic softeners and relatively high levels of cationic dextrin as agent providing the ironing assistant properties.

A paper by J. A. Faucher and E. D. Goddard in J. Colloid and Interface Science 55 (2) 313–319, 1976 describes a study of the effect of, inter alia, a cationic surfactant upon the sorption of cationic hydroxyalkyl cellulose on hair.

DESCRIPTION OF THE INVENTION

It is the object of the present invention to provide a textile conditioning composition which has good softening performance and improved resistance to carry-over of anionic surfactants into the last rinse.

It is a further object of the invention to provide a textile conditioning composition with enhanced fabric softening ability without a substantially increased concentration of cationic materials.

According to the present invention, a textile conditioning composition comprises:

(a) a cationic textile softening agent, as hereinafter defined, and (b) from 0.001 to 0.70% by weight of one or more polymeric cationic salts selected from the group consisting of (i) cationic polysaccharide gums, (ii) cationic starch and starch derivatives (iii) cationic polyvinyl pyridine and polyvinyl pyridinium salts, and co-polymers therewith, (iv) cationic polyvinyl alcohol, (v) cationic polyvinyl pyrrolidone co-polymers, (vi) co-polymer of dialkylaminoalkyl methacrylate, wherein each alkyl has 1–3 carbon atoms, with styrene, or a neutral acrylic ester, (vii) condendsation co-polymers having the repeating unit

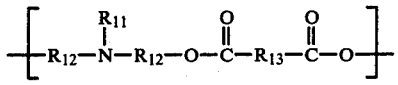

wherein $R_{11}$ is hydrogen or a $C_{1-6}$ alkyl group, or is $R_{12}OA$, wherein A is hydrogen or a $C_{1-20}$ acyl group or a quaternary nitrogen-containing group, each $R_{12}$ independently is a $C_{1-6}$ alkylene group. and $R_{13}$ is a $C_{2-6}$ alkylene, hydroxy alkylene or alkenyl group or an arylene group said copolymer being rendered cationic either by the presence of said quaternary group in some or all of radicals A, or by rendering some or all of the nitrogen atoms in the back bone cationic or by both, (viii) condensation copolymers having the repeating unit

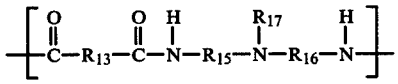

wherein $R_{13}$ is a $C_{1-6}$ alkylene hydroxyalkylene or alkyl or an aryl group, $R_{15}$ and $R_{16}$ independently are a $C_{1-6}$ alkylene group, and $R_{17}$ is hydrogen or a $C_{1-6}$ alkyl group, said copolymer being rendered cationic at some or all of the nitrogen atoms which are not adjacent to CO groups, (ix) condensation copolymers having the repeating unit

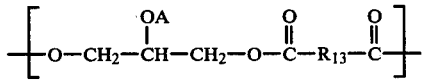

wherein $R_{13}$ is a $C_{1-6}$ alkylene, hydroxy alkylene or alkenylene residue or an aryl group and some or all of radicals A are quaternary nitrogen-containing groups the remainder being hydrogen atoms, and (x) quaternised polyethylenimines having at least 10 ethylenimine residues in the molecule, and (c) optionally a substantially water-insoluble nonionic textile conditioning agent, in amount such that the weight ratio of component (c) to components (a) and (b) together is not greater than 1:10.

Preferably the textiles treated are at least partly made from cellulosic e.g. cotton, fibres. The compositions of the invention may be solids, e.g. granules, or gels, pastes or liquids, or they may be absorbed in or adsorbed on a water-insoluble substrate. Usually they are in the form of more or less viscous liquid dispersion and preferably the disperse phase is liquid crystalline. Such liquid products usually contain from about 1% to about 30% by weight of components (a), (b) and (c) together, more usually from about 3% to 15%, especially from about 4% to 10%.

The carrier liquid when present is aqueous and comprises water for the main part, optionally with some water miscible organic solvent, such as, in particular, methyl, ethyl or isopropyl alcohols.

CATIONIC SOFTENER

The cationic textile softening agents used in compositions of the invention contain in their molecule either one long chain alkyl or alkenyl group having at least 16 carbon atoms, or two alkyl or alkenyl groups, which may be the same or different, each containing 10 to 22 carbon atoms. Mixtures of two or more of these cationic softeners may be used.

Highly preferred cationic softeners for the present invention are substantially water-insoluble quaternary ammonium compounds, and $C_{16-25}$ alkyl imidazolinium salts, conventionally used in fabric softening compositions.

Well-known species of substantially water-insoluble quaternary ammonium compounds have the formula:

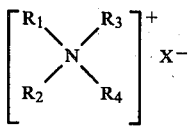

wherein $R_1$ and $R_2$ represent hydrocarbyl groups of from about 10 to 22 carbon atoms; $R_3$ and $R_4$ represent hydrocarbyl groups containing from 1 to about 4 carbon atoms-X is any anion such as a halide, a $C_{2-22}$ carboxylate, or an alkyl- or arylsulf(on)ate. Examples of preferred anions include bromide, chloride, methyl sulfate, toluene-, xylene-, cumene-, and benzene-sulfonate, dodecylbenzenesulfonate, benzoate, parahydroxybenzoate, acetate, propionate and laurate. Representative examples of quaternary softeners include ditallow dimethyl ammonium chloride, ditallow dimethyl ammonium methyl sulfate; dihexadecyl dimethyl ammonium chloride; di(hydrogenated tallow) dimethyl ammonium chloride; dioctadecyl dimethyl ammonium chloride; dieicosyl dimethyl ammonium chloride; didocosyl ammonium chloride; di(hydrogenated tallow) diemthyl ammonium methyl sulfate; dihexadecyl diethyl ammonium chloride; di(coconutalkyl)dimethyl ammonium chloride. Ditallow dimethyl ammonium chloride, di(hydrogeanted tallow) dimethyl ammonium chloride and di(coconutalkyl) dimethyl ammonium chloride are preferred. Also suitable are the single long chained quaternary ammonium compounds of the above formula wherein $R_1$ is a $C_{16}$ to $C_{22}$ alkyl or alkenyl, preferably $C_{16}$ to $C_{20}$ alkyl, and $R_2$, $R_3$ and $R_4$ are lower alkyl groups that is $C_1$ to $C_4$ alkyl groups especially methyl, or aryl groups and X is as defined above. Optionally also two or all three of $R_2$, $R_3$ and $R_4$ may together represent a heterocyclic ring. Some representative examples of such compounds are cetyl and stearyl trimethyl ammonium bromides, behenyl trimethyl ammonium methosulfate, oleyl methyl diethyl ammonium chloride, cetyl, stearyl or oleyl pyridinium chloride, behenyl pyridinium bromide, stearyl methyl morpholinium chloride, stearyl or oleyl ethyl or propyl morpholinium chloride.

Another class of preferred cationic surfactants are the $C_{10-25}$ alkylimidazolinium salts. Preferred salts are those conforming to the formula:

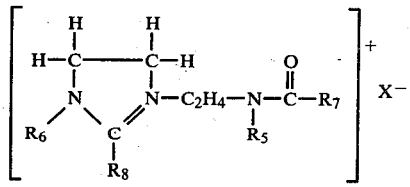

wherein $R_6$ is a $C_1$–$C_4$ alkyl radical, $R_5$ is hydrogen or a $C_1$–$C_4$ alkyl radical, $R_8$ is a $C_{10}$–$C_{25}$ alkyl radical and $R_7$ is hydrogen or a $C_{10}$–$C_{25}$ alkyl radical. X is a charge balancing ion which has the same meaning as X defined in the quaternary ammonium surfactant above.

Preferred members of this class are sold under the Trade Names Varisoft 455 (Ashland Chemical Co.) and Steinaquat (Rewo). Varisoft 455 is believed to be the compound of formula given above wherein $R_6$ is Me, $R_7$ and $R_8$ are tallow alkyl, and $R_5$ is hydrogen.

The above described water-insoluble cationic softeners are very highly preferred in compositions of the present invention and, preferably, comprise the only cationic surfactant present.

Other suitable cationic surfactants, which are water-soluble, are described below; these can be used as the sole cationic surfactant in compositions of the invention, but more preferably are used in combination with the water-insoluble cationic surfactants, in a ratio of water-insoluble to water-soluble of 5:1 to 1:3, especially from 3:1 to 1:1.

Suitable water-soluble cationic surfactants include the substituted polyamine salts of general formula:

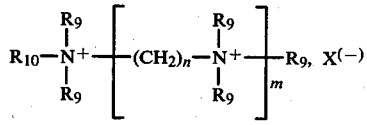

wherein $R_{10}$ is an alkyl or alkenyl groups having from about 16 to 24, preferably from 16 to 20, especially from 16 to 18 carbon atoms, the groups $R_9$ which may be the same or different, each represent hydrogen, a $(C_2H_4O)_pH$, or a $(C_3H_6O)_qH$, or a $C_{1-3}$ alkyl groups where p and q may each be O or a number such that (p+q) does not exceed 25, n is an integer from 2 to 6, preferably 3, m is from about 1 to 9, preferably from 1 to 4, most preferably 1 to 2, and $X^{(-)}$ represents one or more anions having total charge balancing that of the nitrogen atoms.

Preferred compounds of this class, are most preferred, N-tallow-N,N'N',tri-ethanol-1,3-propylene diamine dichloride or di-methosulfate commercially available under the Trade Names Lilamin 540EO3 (Lilachim), Dinoramax SH3, Inopol ODX3 (Pierrefitte Auby), and N-tallow-N,N,N',N',N'-pentamethyl-1, 3-propylene diamine dichloride, commercially available under the Trade Names Stabiran MS-3 (Pierrefitte Auby); Duoquad (Armour Hess); Adogen 477 (Ashland Co.). Also suitable is the substance sold as Dinormac (Pierrefitte Auby) or Duomac (Armour Hess) believed to have the formula:

$$\text{Tallowyl}—N^+H_2—(CH_2)_3—N^+H_3, 2(OCOCH_3)^-$$

or the corresponding chloride. Herein Tallowyl represents predominantly $C_{16}$ and $C_{18}$ alkyl groups derived from tallow fatty acids.

Other suitable cationic surfactants are marketed under the following Trade Names:

Sopa (Pierrefitte Auby)
Sopapa (Pierrefitte Auby)
Lilamin LS33 (Lilachim)
Polaram L 200 (Pierrefitte Auby)
Taflon—320A (Diichi Kogyo Seiyaku Co.).

When the compositions of the invention are in the conventional form or dispersions of active components in an aqueous carrier medium, they usually contain from about 0.1 to 14% cationic surfactant, preferably from about 0.3 to 8% and most preferably about 1% to 5%.

POLYMERIC CATIONIC SALTS

The polymeric cationic salts of the present invention can be amine salts or quaternary ammonium, phosphonium or sulphonium salts. Preferred are quaternary ammonium salts. They include cationic derivatives of natural polymers such as some polysaccharide, gums, starch and certain cationic synthetic polymers such as polymers and co-polymers of cationic vinyl pyridine or vinyl pyridinium halides. Preferably the polymeric salts are water soluble, for instance to the extent of at least 0.5% by weight at 20° C. Preferably they have molecular weight from 1,000 to about 1,000,000, especially from 2,000 to 500,000. As a general rule, the lower the molecular weight the higher the degree of substitution (D.S.) by cationic, usually quaternary groups, which is desirable, or, correspondingly, the lower the degree of substitution the higher the molecular weight which is desirable, but no precise relationship appears to exist.

Of the polysaccharide gums, guar and locust bean gums, which are galactomannam gums are available commercially, and are preferred. Thus guar gums are marketed under Trade Names CSAA M/200, CSA 200/50 by Messrs. Meyhall and Stein-Hall, and hydroxyalkylated guar gums are available from the same suppliers. Other polysaccharide gums commercially available include:

Xanthan Gum
Ghatti Gum
Tamarind Gum
Gum Arabic
Agar.

Cationic guar gums and methods for making them are disclosed in British Pat. No. 1,136,842 and U.S. Pat. No. 4,031,307. Preferably they have a D.S. of from 0.1 to about 0.5.

An effective cationic guar gum is Jaguar C-13S (Trade Name—Meyhall), believed to be derived from guar gum of molecular weight about 220,000, and to have a degree of substitution about 0.13, wherein the cationic moiety has the formula:

$$—CH_2CH(OH)CH_2N^+Me_3, Cl^-$$

Very effective also is guar gum quaternised to a D.S. of about 0.2 to 0.5 with the quaternary grouping:

$$—CH_2CH(OH)CH_2N^+Me_3, Cl^- \text{ or}$$

$$—CH_2CH{=}CHCH_2N^+Me_3, Cl^-$$

Cationic guar gums are a highly preferred group of cationic polymers in compositions according to the invention and act both as scavengers for residual anionic surfactant and also add to the softening effect of cationic textile softeners even when used in baths containing little or no residual anionic surfactant. The cationic guar gums are effective at levels from about 0.03 to 0.7% by weight of the compositions preferably up to 0.4%.

The other polysaccharide-based gums may be quaternised similarly and act substantially in the same way with varying degrees of effectiveness.

Suitable starches and derivatives are the natural starches such as those obtained from maize, wheat, barley etc., and from roots such as potato, tapioca etc., and dextrins, particularly the pyrodextrins such as British gum and white dextrin.

In particular, cationic dextrins such as the above, which have molecular weights (as dextrins) in the range from about 1,000 to about 10,000, usually about 5,000, are effective scavengers for anionic surfactants. Preferably the D.S. is in the range from 0.1 upwards, especially from about 0.2 to 0.8. Also suitable are cationic starches, especially the linear fractions, amylose, quaternised in the usual ways. Usually the D.S. is from 0.01 to 0.9, preferably from 0.2 to 0.7, that is rather higher than in most conventional cationic starches.

The cationic dextrins usually are employed at levels in the range from about 0.05 to 0.7% of the composition, especially from about 0.1 to 0.5%.

Polyvinyl pyridine and co-polymers thereof with for instance styrene, methyl methacrylate, acrylamides, N-vinyl pyrrolidone, quaternised at the pyridine nitrogens are very effective, and can be employed at even lower levels than the polysaccharide derivatives discussed above, for instance at 0.01 to 0.2% by weight of the composition, especially from 0.02 to 0.1%. In some instances the performance seems to fall off when the content exceeds some optimum level such as about 0.05% by weight for polyvinyl pyridinium chloride and its co-polymer with styrene.

Some very effective individual polymeric cationic salts are the following:

Polyvinyl pyridine, molecular weight about 40,000, with about 60% of the available pyridine nitrogens quaternised.

Co-polymer of 70/30 molar proportions of vinyl pyridine/styrene, molecular weight about 43,000, with about 45% of the available pyridine nitrogens quaternised as above.

Co-polymers of 60/40 molar proportions of vinyl pyridine/acrylamide, with about 35% of the available pyridine nitrogens quaternised as above.

Co-polymers of 77/23 and 57/43 molar proportions of vinyl pyridine/methyl methacrylate, molecular weight about 43,000, with about 97% of the available pyridine nitrogens quaternised as above.

These polymeric cationic salts are effective in the compositions at very low concentrations for instance from 0.01% by weight to 0.2% especially from about 0.02% to 0.1%. In some instances the effectiveness seems to fall off, when the content exceeds some optimum level, such as for polyvinyl pyridine and its styrene co-polymer about 0.05%.

Some other effective polymeric cationic salts are:

Co-polymer of vinyl pyridine and N-vinyl pyrrolidone (63/37) with about 40% of the available pyridine nitrogens quaternised.

Co-polymer of vinyl pyridine and acrylonitrile (60/40), quaternised as above.

Co-polymer of N,N-dimethyl amino ethyl methacrylate and styrene (55/45) quaternised as above at about 75% of the available amino nitrogens.

Eudragit E (Trade Name of Rohm GmbH) quaternised as above at about 75% of the available amino nitrogens. Eudragit E is believed to be co-polymer of N,N-dialkyl amino alkyl methacrylate and a neutral acrylic acid ester, and to have molecular weight about 100,000 to 1,000,000.

Co-polymer of N-vinyl pyrrolidone and N,N-diethyl amino methyl methacrylate (40/50), quaternised at about 50% of the available amino nitrogens.

These cationic polymers may be prepared in a known manner by quaternising the basic polymers.

Yet other co-polymers are condensation polymers, formed by the condensation of two or more reactive monomers both of which are bifunctional. Two broad classes of these polymers may be formed which are then made cationic, viz (a) those having a nitrogen atom which may be cationic in the back bone, and (b) those not containing a nitrogen which may be made cationic in the back bone but containing a reactive site which will facilitate introduction of a cationic group.

Compounds of class (a) may be prepared by condensing a tertiary or secondary amine of formula:

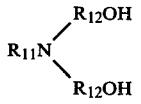

wherein $R_{11}$ is H or a $C_{1-6}$ alkyl group, preferably methyl, or $R_{12}OH$ and each $R_{12}$ independently is a $C_{1-6}$ alkylene group, preferably ethylene, with a dibasic acid, the corresponding acyl halide or anhydride having formula $$XOOC\ (R_{13})\ COOX$$

or

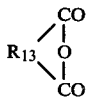

wherein $R_{13}$ is a $C_{1-6}$ alkylene, hydroxy alkylene or alkenyl group or an aryl group, and X is H, or a halide preferably chloride. Some suitable acids are succinic, malic, glutaric, adipic, pimelic, suberic, maleic, ortho-, meta- and tere-phthalic, and their mono and di-chlorides. Very suitable anhydrides include maleic and phthalic anhydrides. The condensation leads to polymers having repeating units of structure

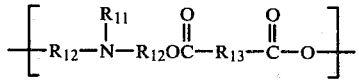

Reactions of this sort are described in British Pat. No. 602.048.

These can be rendered cationic for instance by addition of an alkyl or alkoyl halide or a di-alkyl sulphate at the back bone nitrogen atoms or at some of them. When $R_{11}$ is ($R_{12}OH$) this group can be esterified by reaction with a carboxylic acid, e.g. a $C_{1-20}$ saturated or unsaturated fatty acid or its chloride or anhydride. When long chain, about $C_{10}$ and higher, fatty acids are employed these polymers may be described as "comb" polymers. Alternatively when $R_{11}$ is ($R_{12}OH$) the $R_{11}$ groups may be reacted with a cationic e.g. a quaternary ammonium group such as glycidyl trimethyl ammonium chloride or 1-chlorobut-2-ene trimethyl ammonium chloride, and like agents mentioned hereinafter.

Some cationic polymers of this class can also be made by direct condensation of a dicarboxylic acid etc. with a difunctional quaternary ammonium compound having for instance the formula $$R_{11}R_{14}N^{+}(R_{12}OH)_2,\ Z^{-}$$

where $R_{14}$ is an H or $C_{1-6}$ alkyl group, and $R_{11}$ and $R_{12}$ are as defined above, and $Z^{-}$ is an anion.

Some non limiting typical examples of polymers of this class have repeating units as follows:

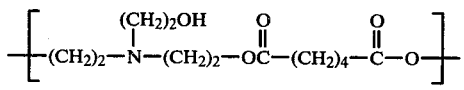

(a)

from triethanolamine and adipic acid or its acid di-chloride.

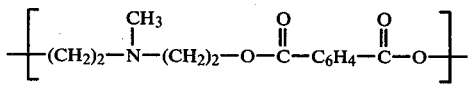

(b)

from methyl diethanolamine and ortho or tere phthalic acid or phthalic anhydride

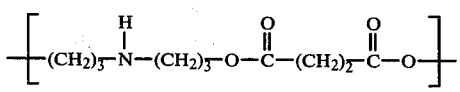

(c)

from dipropanolamine and succinic acid or anhydride

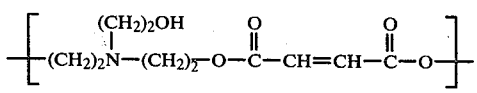

(d)

from triethanolamine and maleic anhydride.

Cationic derivatives of these polymers may be illustrated by the following, based on polymers of class (a).

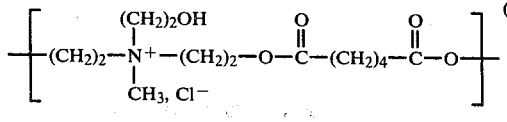

(e)

by quaternisation of the back bone nitrogen by methyl chloride.

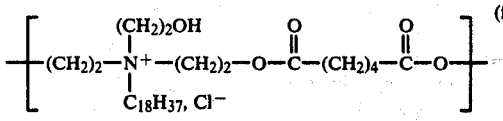

(f)

by quaternisation of the back bone nitrogen by octadecyl chloride

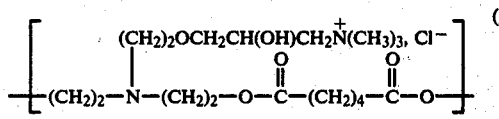

(g)

by reaction of the ethanol branches with glycidyl trimethyl ammonium chloride.

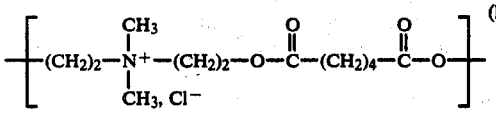

(h)

by direct condensation polymerisation of dimethyl diethanol ammonium chloride with adipic acid.

Another class of copolymer with nitrogens which can be made cationic in the back bone can be prepared by reaction of a dicarboxylic acid, etc. as defined above with a dialkylene triamine, having structure

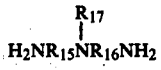

where $R_{15}$ and $R_{16}$ independently each represent a $C_{2-6}$ alkylene group, and $R_{17}$ is hydrogen or a $C_{1-6}$ alkyl group. This leads to polymers having the repeating unit

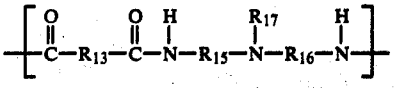

wherein the nitrogen not directly linked to a CO group i.e. not an amide nitrogen, may be rendered cationic, as by reaction with an alkyl halide or dialkyl sulphate.

Some non limiting typical examples of polymers of this class are as follows:

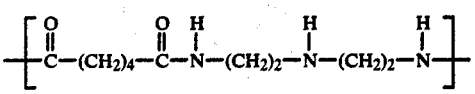

(a)

from diethylene triamine and adipic acid, leading by reaction with e.g. excess $(CH_3)_2SO_4$ to

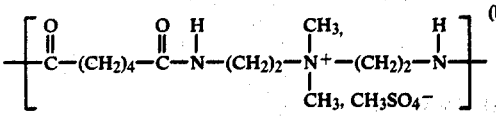

(b)

-continued

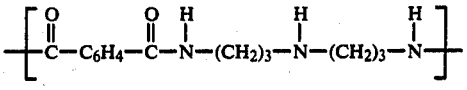

from diproplyene triamine and phthalic acid or anhydride, leading by reaction with e.g. excess $C_{12}H_{25}I$ to

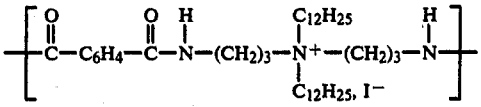

Commercial examples of a condensation polymers believed to be of this class are sold under the generic Trade Name Alcostat by Messrs. Allied Colloids.

Yet other cationic polymeric salts are quaternised polyethyleneimines. These have at least 10 repeating units, some or all being quaternised, that is having the formula:

| Layer A-Immediate Release Ingredient | mg/tablet |
|---|---|
| FMA-11* | 160.0 |
| Methylcellulose | 5.8 |
| Magnesium Oxide | 80.0 |
| Primojel** | 10.0 |
| Magnesium Stearate | 2.5 |
| Total | 258.3 |

*Aluminum hydroxide-magnesium carbonate co-precipitate - Reheis Co.
**Sodium carboxymethyl starch - E. Mendel & Co., Carmel, New York where $R_{18}$ is $C_{1-20}$ alkyl, or benzyl, and X is an anion.

Commercial examples of polymers of this class are also sold under the generic Trade Name Alcostat by Messrs. Allied Colloids.

It will be appreciated by those skilled in the art that these quaternisation and esterification reactions do not easily go to completion, and usually a degree of substitution up to about 60% of the available nitrogen is achieved and is quite effective. Thus it should be understood that usually only some of the units constituting the cationic polymers have the indicated structures.

Polymers of class (b), with no nitrogen in the back bone can be made by reacting a triol or higher polyhydric alcohol with a dicarboxylic acid etc. as described above. Employing glycerol, for example, thus leads to polymers having the repeating unit

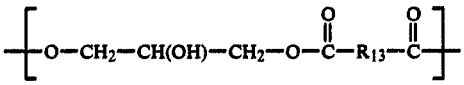

wherein $R_{13}$ is as defined above. These polymers can be reacted with cationic groups at all the hydroxyls, or at some of them.

Of course, mixtures of any of the above described polymeric cationic salts may be employed, and the selection of individual polymers or of particular mixtures can be used to control the physical properties of the compositions such as their viscosity and the stability of the aqueous dispersions.

These cationic salts of condensation polymers are usually effective at levels of from about 0.01% or even lower to about 0.7% by weight of the compositions of the invention, especially up to about 0.5%.

Preferred above all other types of cationic polymeric material are the cationic polysaccharides, especially cationic galactomannam gums (such as guar gum) and cationic derivatives. These materials are commercically available and relatively inexpensive. They have good compatibility with cationic surfactants and allow stable, highly effective softening compositions according to the invention to be prepared. Such polymeric materials are preferably used at a level of from 0.03% to 0.5% of the composition.

NONIONIC SOFTENER COMPONENT

Compositions of the present invention can also include low levels of nonionic textile conditioning agents. These materials are generally esters of fatty acids or fatty alcohols, especially $C_8$–$C_{18}$ fatty acid esters of a polyhydric alcohol containing from 2 to 8 carbon atoms. Suitable materials are more fully described in German Offenlegungsschrift No. 2,631,114. Preferred are glycerol and sorbitan partial esters with fatty acids, which may be saturated and unsaturated, having from about 10 to 26 carbon atoms, especially glycerol monopalmitate, monostearate, mono-oleate, and corresponding sorbitan mono- and di-esters. As generally obtained these mono- and di-esters contain appreciable proportions of the higher esters.

These nonionic components are optional, but if present they are at a level such that the ratio of nonionic softener to total cationic components (a) and (b) does not exceed 1:10.

The compositions may contain other compatible components such as bactericides and fungicides, whether to protect the products or fabrics treated therewith from attack, tarnish inhibitors, viscosity modifiers, emulsifying agents, other textile conditioning agents and components having aesthetic properties, such as perfumes and colours.

In preparing the liquid products according to the invention any effective method of mixing the components may be used. In general it is usually desirable to make a premix by melting together the softener components (a), (b) and (c), often at a temperature of about 65° C. Especially in cases where these components include appreciable amounts of free amines, an acid or acid anhydride is added in small amounts to protonate said amines. This premix is added with appropriate mixing, sometimes high shear mixing being necessary, to a water mixture at a temperature above the melting point of the premix containing the water for the composition together with mostly the water soluble components such as colour, bactericide and sometimes a small amount of an electrolyte such as calcium chloride. The mixture is allowed to cool usually with continued stirring. The products are usually weakly acidic, partly to ensure that at least a substantial proportion of any amines present is protonated. The preferred pH of the products is from about 3 to 7, especially from about 4.5 to 5.5

The invention also embraces a method of softening fabrics which comprises steeping them in an aqueous liquor comprising from 20 to 2,000, preferably about 200 parts per million by weight of the combination of:

(a) a cationic surfactant having either one alkyl chain having 12 to 22 carbon atoms or two alkyl chains having 10 to 22 carbon atoms in the molecule, and
(b) a polymeric cationic salt as described hereinbefore, preferably at a level of 0.5 to 20 parts per million.

Preferably said combination is provided by a composition comprising a substantially water insoluble cationic textile softener agent as hereinbefore defined, and from 0.001 to 0.7% by weight of the composition of said polymeric cationic salt.

Preferably the cationic surfactant is a cationic softener having one alkyl chain of 16 to 22 carbon atoms or two alkyl chains having 10 to 22 carbon atoms in the molecule.

In general, very highly preferred compositions of the invention, for reasons of performance and also of availability and cost of components, comprise by weight from 3% to 5% ditallow dimethyl ammonium chloride, methosulphate or other salt, and either from 0.05 to 0.15% of cationic guar gum of D.S. From 0.2 to 0.5 or from 0.16 to 0.3% of cationic guar gum of D.S. from 0.05 to 0.19.

EXAMPLES

The following compositions were prepared, the balance of the compositions consisting of water with minor amounts of perfume and colouring matter.

| Example No. | | | |
|---|---|---|---|
| 1. | 4.0% DTDMAC | 0.2% | polyvinyl alcohol quaternised with epoxypropyl trimethyl ammonium chloride, D.S. about 0.06, PVA molecular weight about 14,000. |
| 2. | 4.0% DTDMAC | 0.03% | Poly(vinyl pyridine)/(methyl methacrylate) 57/47 by weight mixture quaternised by methyl halide. |
| 3. | 4.0% DTDMAC | 0.2% | GAFQUAT 755 (Trade Name) believed to be high molecular weight co-polymer of vinyl pyrrolidone, M.wt about 1,000,00. |
| 4. | 4.0% DTDMAC | 0.1% | Eudragit E quaternised with methyl halide at about 75% of the available amino nitrogen atoms. Eudragit E (Trade Name) is believed to be a co-polymer of N,N-dialkyl amino alkyl methacrylate with a neutral acrylic ester. |
| 5. | 4.0% DTDMAC | 0.03% | Poly (vinyl pyridine)/(styrene) 70/30 by weight mixture quaternised by methyl |

-continued

| Example No. | | | |
|---|---|---|---|
| | | | halide at about 45% of the available pyridine nitrogen atoms. |
| 6. | 3.0% DTDMAC | 0.2% | Jaguar C-13S (Trade Name) believed to be guar gum quaternised to a D.S. of about 0.13 |
| 7. | 4.0% DTDMAC | 0.1% | Cationic guar gum. Guar gum quaternised to D.S. 0.25. |
| 8. | 4.0% DTDMAC | 0.2% | Modocoll (Trade Name) quaternised to a D.S. of about 0.5 by epoxypropyl trimethyl ammonium chloride. |
| 9. | 4.0% DTDMAC | 0.20% | Cationic xanthan gum. |
| 10. | 4.0% DTDMAC | 0.20% | British gum quaternised to D.S. 0.4 with epoxypropyl trimethyl ammonium chloride. |
| 11. | 4.0% DTDMAC | 0.1%<br>0.3% | Cationic guar gum as in Example 9, and glycerol monostearate. |

All these products provided substantially the same softening performance as a composition comprising 5.8% DTDMAC typical of prior art textile softening compositions.

Substantially similar performance is obtained when the DTDMAC is replaced by an equal amount of ditallow dimethyl ammonium methosulphate, -toluene sulphonate, acetate, or benzoate, and also when the DTDMAC is replaced by an equal amount of Varisoft 455 (Trade Name—a tallow-based imidazolinium salt). Effective compositions are also obtained when the DTDMAC is replaced by $C_{16-20}$ alkyl pyridinium halide. $C_{16-20}$ alkyl methyl morpholinium halides, N-tallow-N,N$^1$N$^1$-triethanol-1,3-propylene diamine dichloride.

14. A textile softening composition in the form of a paste and intended to be used in a rinse bath at lower than present conventional concentrations, e.g. at 0.05–0.1% by weight of the composition in the rinse liquor comprises:
    8.5% DTDMAC
    4.0% N-tallow-N,N$^1$, N$^1$-triethanol propylene diamine dichloride
    0.2% Guar gum, quaternised to a D.S. of 0.3 with epoxypropyl trimethyl ammonium chloride.
    Balance to 100—water with minor amounts of perfume, colour, bactericide, etc.
15. A textile conditioning composition comprises:
    3.0% Varisoft 455 (Trade Name for tallow imidazoline)
    0.4% Cationic guar gum as employed in Example 9.
    Balance to 100—water and minor components.
16. A wash using natural soiled fabrics is carried out in a domestic washing machine (Miele 422) using the "boil wash" cycle, with a conventional heavy duty anionic detergent-based detergent composition. Desized terry towelling test pieces are included among the soiled fabrics. At the last rinse, 90 g of a textile softening composition to be tested are added to 30 liters of the rinse liquor. The test swatches are removed with the treated fabrics, and dried. Their softness is compared by a panel of judges with that of swatches treated similarly with different softener compositions, using a paired-comparison technique.

The results indicate that a composition comprising 3.8% DTDMAC was perceptibly less effective than one containing 5.8% DTDMAC, typical of prior art textile softeners. A compositions comprising
    4.0% DTDMAC
    0.2% Jaguar C13-S
is at least as effective as that with 5.8% DTDMAC.

17–18. Textile softening compositions having substantially equivalent softening effectiveness to that of a composition based upon 5.8% DTDMAC alone, had the composition:

| | 17 | 18 |
|---|---|---|
| DTDMAC | 4.5 | — |
| Imidazolinium softeners (1) | — | 4.5 |
| Cationic polymeric salt (2) | 0.2 | 0.2 |
| Water | to 100 | |

(1) Varisoft 455 (Trade Name Ashalnd Chemical Co.) or Steinaquat (Trade Name Rewo).
(2) Alcostat PB (Trade Name Allied Colloids Ltd) believed to be a cationic comb co-polymer of triethanolamine and a dicarboxylic acid further esterified with, typically, stearic acid followed by quaternisation using dimethyl sulfate.

19–20. Textile softening compositions comprise:

| | 19 | 20 |
|---|---|---|
| DTDMAC | 4.5 | 4.0 |
| Alcostat C | 0.2 | 0.4 |
| Water | to 100 | |

Alcostat C (Trade Name Allied Colloids Ltd) is believed to be a quaternised polyethylene salt.

What is claimed is:

1. A textile conditioning composition comprising:
(a) a cationic textile softening agent having either one alkyl or alkenyl group with at least 16 carbon atoms or two alkyl or alkenyl groups having from 10 to 22 carbon atoms,
(b) from 0.001 to 0.70% by weight of a polymeric cationic salt or mixture of such salts selected from the group consisting of
    (i) cationic polysaccharide gums,
    (ii) cationic starch and starch derivatives
    (iii) polyvinyl pyridine and polyvinyl pyridinium salts and co-polymers therewith,
    (iv) cationic polyvinyl alcohol,
    (v) cationic polyvinyl polyvinyl pyrrolidone co-polymers
    (vi) co-polymer of dialkylaminoalkyl methacrylate, wherein each alkyl has 1–3 carbon atoms, with styrene, or a neutral acrylic ester,
    (vii) condensation co-polymers having the repeating unit

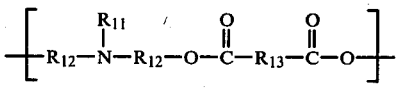

wherein $R_{11}$ is hydrogen or a $C_{1-6}$ alkyl group, or is $R_{12}OA$, wherein A is a hydrogen or a $C_{1-20}$ acyl group or a quaternary nitrogen-containing group, each $R_{12}$ independently is a $C_{1-6}$ alkylene group, and $R_{13}$ is a $C_{1-6}$ alkylene, hydroxy alkylene or alkenylene group or an arylene group said co-polymer being rendered cationic either by the presence of said quaternary group in some or all of radicals A, or by rendering some or all of the nitrogen atoms in the back bone cationic, or by both, (viii) condensation co-polymers having the repeating unit

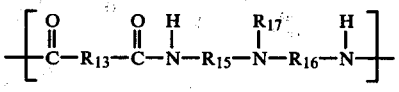

wherein $R_{13}$ is a $C_{1-6}$ alkylene hydroxyalkylene or alkyl or an aryl group, $R_{15}$ and $R_{16}$ independently are a $C_{1-6}$ alkylene group, and $R_{17}$ is hydrogen or a $C_{1-6}$ alkyl group, said co-polymer being rendered cationic at some or all of the nitrogen atoms which are not adjacent to CO groups, (ix) condensation co-polymers having the repeating unit

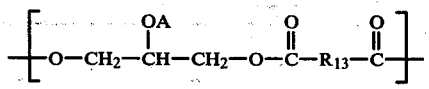

wherein $R_{13}$ is a $C_{1-6}$ alkane, hydroxy alkane or alkene residue or an aryl group and some or all of radicals A are quaternary nitrogen-containing groups the remainder being hydrogen atoms, and (x) quaternised polyethyleneimines having at least 10 ethyleneimine residues in the molecule, and (c) optionally a substantially water-insoluble nonionic textile conditioning agent, in amount such that the weight ratio of component (c), if present, to components (a) and (b) together is not greater than 1:10.

2. The composition of claim 1 wherein said polymeric cationic salt has more than 10 monomeric units in the molecule.

3. The composition of claim 2 in the form of an aqueous dispersion and containing from 1% to 30% by weight of components (a), (b) and (c) together.

4. A textile conditioning composition in the form of an aqueous dispersion, consisting essentially of:

(a) from 0.1% to 14% by weight of a substantially water-insoluble cationic softener, and (b) from 0.03% to 0.5% by weight of a cationic polysaccharide having more than 10 monomeric units in the molecule, the balance of the composition being water.

5. The composition of claim 4, wherein the cationic softener is selected from the group consisting of:

(a) non-cyclic quaternary ammonium salts having two $C_{10-25}$ alkyl chains, (b) $C_{16-26}$ alkyl imidazolinium salts, and (c) mixture thereof.

6. The composition of claim 4, wherein the cationic softener is present in an amount of from 0.3% to 8%.

7. The composition of claim 5, wherein the cationic polysaccharide is a cationic guar or locust bean gum of degree of substitution from 0.1 to 0.5.

8. The composition of claim 5, wherein the cationic polysaccharide is a cationic dextrin having a molecular weight, of dextrin, from 1,000 to 10,000 and D.S. from 0.2 to 0.8.

9. The composition of claim 7, wherein the cationic groupings on the anhydro sugar residues of the guar gum have a formula selected from:

(a) $CH_2CH{=}CHCH_2N^+Me_3, Cl^-$ and (b) $CH_2CH(OH)CH_2N^+Me_3, Cl^-$.

10. The composition of claim 7, which comprises by weight from 3% to 5% of ditallow dimethyl ammonium chloride or methosulphate and from 0.05% to 0.15% of cationic guar gum with a degree of substitution from 0.2 to 0.5.

11. The composition of claim 7, which comprises by weight from 3% to 5% of ditallow dimethyl ammonium chloride or methosulphate and from 0.16% to 0.3% of cationic guar gum with a degree of substitution from 0.05 to 0.19.

* * * * *

UNITED STATES PATENT AND TRADEMARK OFFICE

CERTIFICATE OF CORRECTION

PATENT NO. : 4,179,382

DATED : December 18, 1979

INVENTOR(S) : Arthur L. Rudkin et al

It is certified that error appears in the above-identified patent and that said Letters Patent are hereby corrected as shown below:

On the title page, the following priority information should be inserted:

Foreign Application Priority Data

November 21, 1977 United Kingdom 48377 (provisional)

May 30, 1978 United Kingdom 48377 (complete)

Column 4, line 56, "1 to 2" should be --1 or 2--.

Column 10, lines 23-33, replace what is at these lines with

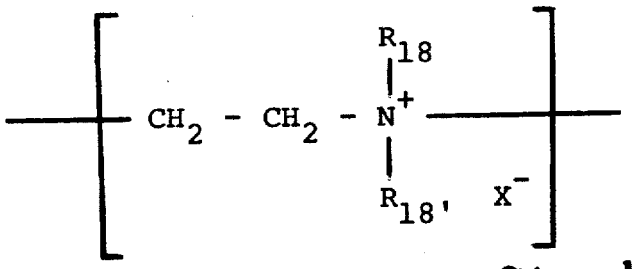

Signed and Sealed this

Eleventh Day of March 1980

[SEAL]

Attest:

SIDNEY A. DIAMOND

Attesting Officer

Commissioner of Patents and Trademarks